US009770725B2

(12) United States Patent
Weatherbee

(10) Patent No.: US 9,770,725 B2
(45) Date of Patent: Sep. 26, 2017

(54) SPRINKLER APPARATUS

(71) Applicant: Randy Weatherbee, Cheney, WA (US)

(72) Inventor: Randy Weatherbee, Cheney, WA (US)

( * ) Notice: Subject to any disclaimer, the term of this patent is extended or adjusted under 35 U.S.C. 154(b) by 114 days.

(21) Appl. No.: 14/871,831

(22) Filed: Sep. 30, 2015

(65) Prior Publication Data

US 2017/0087564 A1 Mar. 30, 2017

(51) Int. Cl.

| | |
|---|---|
| ***B05B 15/06*** | (2006.01) |
| ***B05B 1/18*** | (2006.01) |
| ***B05B 1/30*** | (2006.01) |
| ***B05B 1/20*** | (2006.01) |

(52) U.S. Cl.

CPC ..... *B05B 1/185* (2013.01); *B05B 1/20* (2013.01); *B05B 1/3026* (2013.01); *B05B 15/061* (2013.01); *B05B 15/066* (2013.01); *B05B 15/069* (2013.01)

(58) Field of Classification Search

CPC ..... B05B 1/185; B05B 1/3026; B05B 15/061; B05B 15/069; B05B 1/20; B05B 15/066

USPC ..... 239/525, 530, 532, 581.1, 548, 552, 239/556–559, 533.1, 229, 251, 587.1, 588

See application file for complete search history.

(56) References Cited

U.S. PATENT DOCUMENTS

| | | | | |
|---|---|---|---|---|
| 3,679,135 | A | 7/1972 | Grosch | |
| 3,679,136 | A | 7/1972 | Snyder | |
| 5,671,889 | A * | 9/1997 | Petty | B05B 15/066 239/532 |
| 6,378,791 | B1 * | 4/2002 | Perry | B05B 1/3026 239/530 |
| 6,585,174 | B1 * | 7/2003 | Huang | B05B 1/3026 239/530 |

* cited by examiner

*Primary Examiner* — Steven J Ganey
(74) *Attorney, Agent, or Firm* — Lee & Hayes, PLLC

(57) ABSTRACT

An apparatus including a hose having a first connector on a first end of the hose and a second connector on a second end of the hose. A sprinkler head attaches to the first connector of the hose. A handheld water pressure adjustment device attaches to the second connector of the hose. When the hose is pressurized with water, the hose becomes substantially rigid such that the length of the hose extends in a rigid, stable manner and the pressure behind the sprinkler head causes the sprinkler head to extend and hover. A direction of movement of the sprinkler head while hovering is directed by a user holding the water pressure adjustment device.

20 Claims, 7 Drawing Sheets

SPRINKLER APPARATUS

BACKGROUND

The act of watering plants, trees, flower beds, gardens, and lawns may be performed in many different ways. In some instances, sprinklers are utilized to water fixed portions of an area without direct and/or constant supervision, and with minimal user interaction. While this may be effective in some instances, it often requires running the sprinklers for long durations to adequately water an entire area due to the variability of the distribution of the water spray from the sprinkler. In some instances, one may desire to water a particular location, which may be otherwise unreachable by the sprinklers or which may need additional or special attention. In such a circumstance, to use a sprinkler system (manual or automatic) to water the particular location may be impossible, impracticable, or wasteful.

There are many types of sprinklers available for watering. Sprinklers may be used in automatically controlled systems and "manually" controlled devices. Automatic systems may generally be installed in fixed underground locations and interconnected to a programmable circuit. Many automatic systems include one or more series (or "zones") of sprinkler heads that provide water to predefined sub-sections of an area. This type of sprinkler system often uses combinations of different types of sprinkler heads including heads with nozzles that spray in a fixed-orientation and nozzles that are actuated to rotate or pivot between two points so as to cover a particular area. Automatic systems may alleviate some of the watering burden on a user because, once installed, the activation of the watering system is typically programmed to run without further intervention, other than occasional maintenance or adjustment of the program.

"Manually" controlled devices may include simple hose attachments that may require an operator to maintain control throughout the entire time of use such as, for example, a handheld, adjustable spraying nozzle that connects to the hose. Other "manual" devices, while not requiring a user to remain present to operate, may still require attention from the user to periodically to turn on/off the sprinkler and/or to move the sprinkler to cover different areas needing watering.

Regardless of the watering system/device/method used, some areas that need water may be challenging to accomplish in a time-efficient and cost-effective manner.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

Overview

Figure 1A:
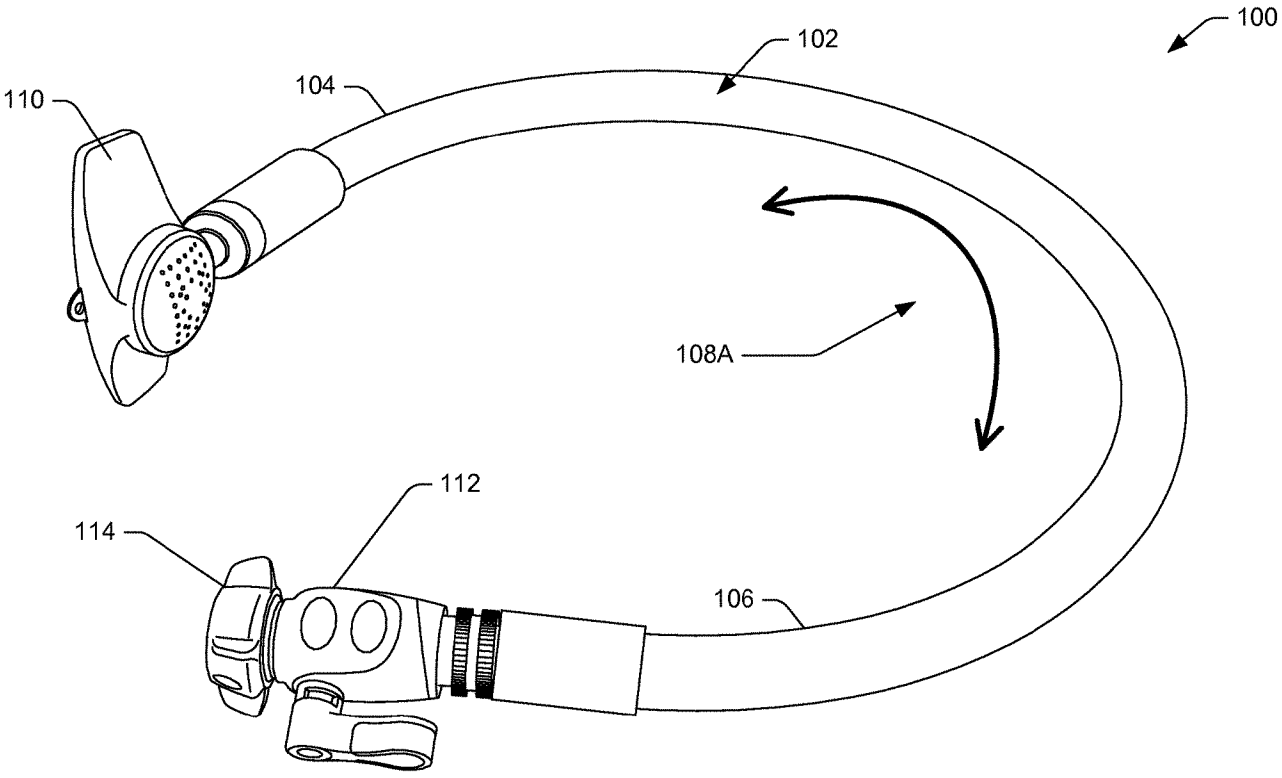
FIG. 1A illustrates a perspective view of an example embodiment of a sprinkler apparatus in an unpressurized state.

This disclosure is directed to a manually controlled sprinkler watering device. The watering device may be used generally anywhere. In an embodiment, the device may be used for concentrated watering of areas that may be difficult to reach, such as under and between bushes and small plants to provide water directly to the soil and thereby the roots.

The watering device may include a section of hose terminating on one end with a sprinkler head, and terminating on the other end with a handheld pressure valve. The hose may have a generally static curvature in the shape thereof when in an unpressurized state (i.e., when no water is flowing through the pressure valve). In the unpressurized state, the sprinkler head may face toward the pressure valve and/or the inner curvature of the hose. When the watering device is in a pressurized state (i.e., water flows through the pressure valve into the hose and out the sprinkler head), the force of the water in the hose may cause the sprinkler head to move away from the pressure valve and the hose to extend out of the curved state (e.g., into a substantially straight state, or into another curved state different than the curved state when the watering device is in an unpressurized state). Furthermore, due to the force of the water exiting the sprinkler head downward, the sprinkler head "floats" or "hovers" in the air, and the user may then control the direction of extension by simply moving his arm in the direction desired.

Several factors may be involved in the control and functionality of the watering device, including: the weight of the sprinkler head and hose; the length of the hose (which affects the overall weight as well); the thickness and flexibility/rigidity of the hose material; the amount of water pressure from the source; the shape and number of apertures in the sprinkler head; and the amount of pressure being provided by the user via the adjustable pressure valve. Each of these factors may contribute to the actuation of the instant device, however, as discussed further herein, some ranges of values of some of the above factors may be provided as examples. For example, the actual pressure of the water may depend on the water pressure at the water source such as the spigot on the user's house, over which a user may have little control and the pressure is further adjustable by hand. As such, a pressure value may vary widely. Regardless, in an example embodiment, a volumetric flow rate of water from a water source, which induced the sprinkler head to hover, ranges from about 3.5 gal/min to 5 gal/min.

The handheld adjustable pressure valve may include a lever or other actuatable mechanical structure to allow the user to modify the amount of water flow, and thus the water pressure in the hose, to raise or lower the sprinkler head. The lever may be oriented to face away from the inner curvature of the hose at rest, such that the user may hold the pressure valve naturally in his or her hand and (in the case depicted in FIGS. 1A and 1B) control the water pressure using his or her thumb. Further, the valve may be a ball-type valve, or any other manually adjustable valve that is manipulable with one hand.

The sprinkler head may be light in weight so as to float or hover above the ground when the device is pressurized, yet sufficiently heavy to prevent wild or erratic movement under pressure. Specifically, the weight of the sprinkler head may be proportional to the weight of the hose. For example, in some instances the weight of the sprinkler head may range between 0.1-0.4 lbs or between 0.2-0.3 lbs. Whereas the weight of the hose may range, for example, between 0.3-1.3 lbs or between 0.6-1.0 pound. Therefore, the weight of the sprinkler head may range between 25%-40% or between 30%-35% of the weight of the hose.

Additionally, the sprinkler may include a face plate having a random or patterned plurality of apertures therein. The face plate may be removable to exchange with other face plates having different aperture groupings or patterns. Alternatively, the face plate may rotate to various positions presenting different flow patterns. The sprinkler may also have protrusions that extend from opposing sides. In some instances, the protrusions may extend like wings and may provide better balance to the device when pressurized. Furthermore, the flow of the water may be adjusted to make the sprinkler head hover more stably.

Inasmuch as the hose may be formed by sectioning larger lengths of a hose, one end of the hose may have a male connection member that connects with a female connection member on the sprinkler head, and the other end of the hose may have a female connection member to connect with the male connection member of the pressure valve. An example embodiment of forming the various connections may include inserting a hose connection coupler to couple the connection means to the ends of the hose. A silicon adhesive may be applied to the joint to make a tight seal, and shrink tubing may be applied over the coupler to cover the rough edges of the coupler and help seal the joint. Alternatively, the connections may include threaded connections, quick connect, hose clamps, etc.

Illustrative Embodiments of a Sprinkler Watering Device

Figure 1B:
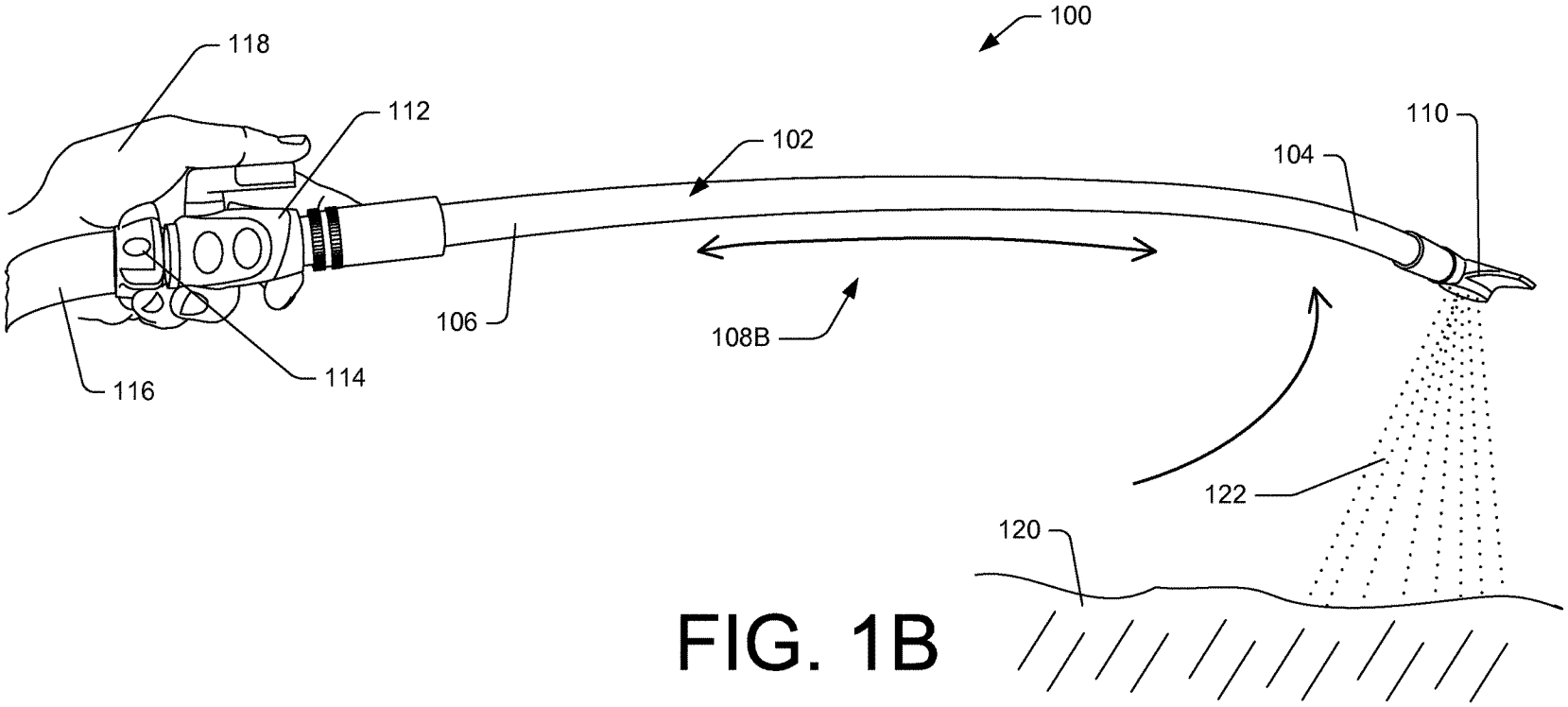
FIG. 1B illustrates a side view of an example embodiment of the sprinkler apparatus of FIG. 1A in a pressurized state.

An illustrative embodiment of a sprinkler watering device 100 according to this application is illustrated in FIGS. 1A and 1B. The device may include a hose 102 having a first end 104 and a second end 106. FIG. 1A illustrates the hose 102 in an unpressurized state such that a curvature 108A is shown. The amount of naturally occurring curvature in the hose 102 may be minimal. For example, the curvature 108A between the first and second ends 104, 106 of the hose 102 may range from about 1 to 50 degrees, or from about 10 to 40 degrees. The hose 102 may be flexible such that the curvature 108A may be stretched to a straight or nearly straight position, as depicted in the line of extension 108B in FIG. 1B. For example, when the hose 102 is pressurized, as depicted in FIG. 1B, the hose 102 extends and the amount of curvature 108A is reduced.

A length of the hose 102 may range from about 2 to 5 feet, or from about 2.5 to 4 feet, or from about 3 to 3.5 feet. The length of the hose 102 may vary depending on the type of material of the hose, the wall thickness, the diameter, the rigidity, etc. For example, for a premium duty, ⅝ inch diameter, 8-ply, nylon reinforced garden hose, the length may be about 3 feet long.

The device may further include a sprinkler head 110 and a handheld pressure valve 112 connected respectively to the first end 104 and the second end 106 of hose 102. The handheld pressure valve 112 may further include a hose coupler 114, with which the handheld pressure valve 112 may be coupled to a secondary hose 116 as a water source to pressurize hose 102. Thus, as shown in FIG. 1B, when device 100 is pressurized by a water source, such as the secondary hose 116, and supported by user hand 118 holding the pressure valve 112, the force of the water may cause the hose 102 to extend such that the sprinkler head 110 moves away from the pressure valve 112, where the direction "away from the pressure valve" may indicate that the sprinkler head moves in a direction against the naturally imparted curvature of the hose 102. Further, a ground surface 120 may assist in creating lift for the sprinkler head 110 under the force of the water 122 hitting the ground surface 120.

Figure 2A:
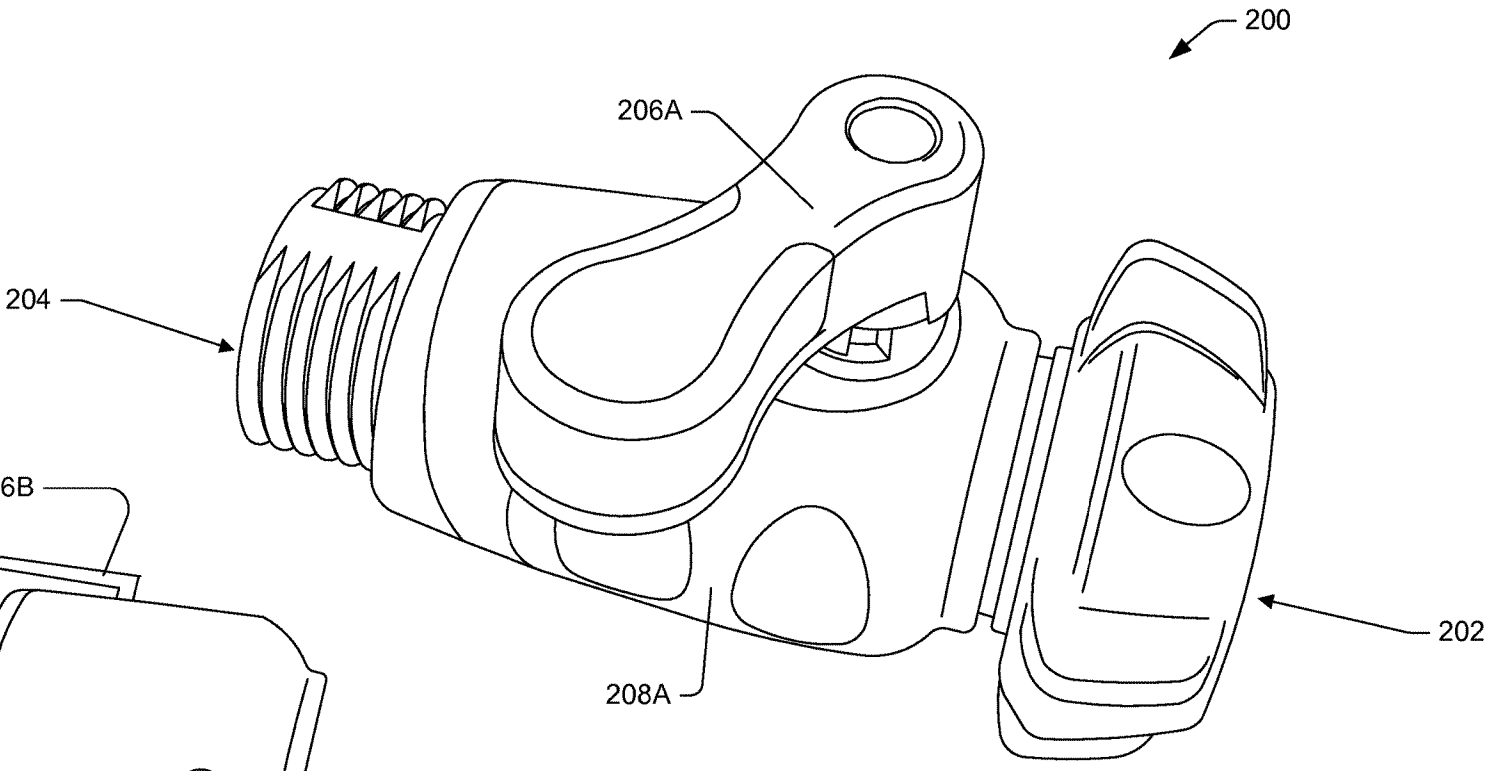
FIG. 2A illustrates a perspective view of an example embodiment of a pressure adjustment valve.
Figure 2B:
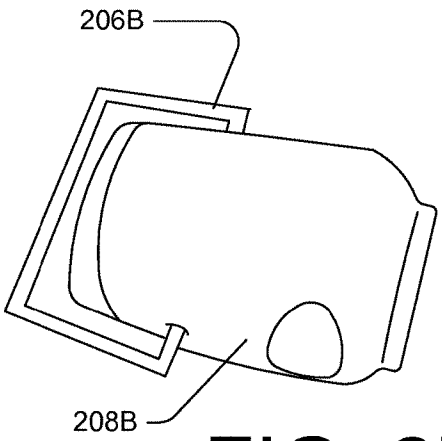
FIG. 2B illustrates a perspective view of an example embodiment of a pressure adjustment valve.

A handheld pressure valve 200, as seen in FIG. 2A, may be manually adjustable to adjust the amount of water flowing into the hose 102. A first end 202 of the handheld pressure valve 200 may include a connection member to connect to a secondary hose 116, and a second end 204 may have a connection member, such as a threaded surface, to connect the pressure valve 200 to the hose 102 of device 100. In some instances, the pressure valve 200 may include a lever 206A with which the water pressure in the device 100 may be adjusted as desired. Although FIG. 2A depicts the lever 206A as having a single pivot point about which the lever 206A rotates, other embodiments are contemplated. For example, the lever 206B may include two rotation points on opposite sides of the pressure valve 208B, forming a rectangular bar (or semi-circular bar or other shape) around half of the pressure valve. In an embodiment, the pressure valve 200 may further include a hand grip 208A, 208B for manually gripping to assist in controlling the direction of the device 100.

Moreover, in some instances, the lever 206A, 206B may be bi-directional. That is, to accommodate both left-handed and right-handed users, the lever 206A (206B) may rotate to the left and to the right (up and down) to open the water pressure valve in both directions. Regardless of the rotation, the lever 206A, 206B of the pressure valve 200 may be located so as to extend from a position outside of the curvature 108A of the hose 102 and away from the sprinkler head 110, which faces toward an inside of the curvature 108A (see FIG. 1A).

Figure 3A:
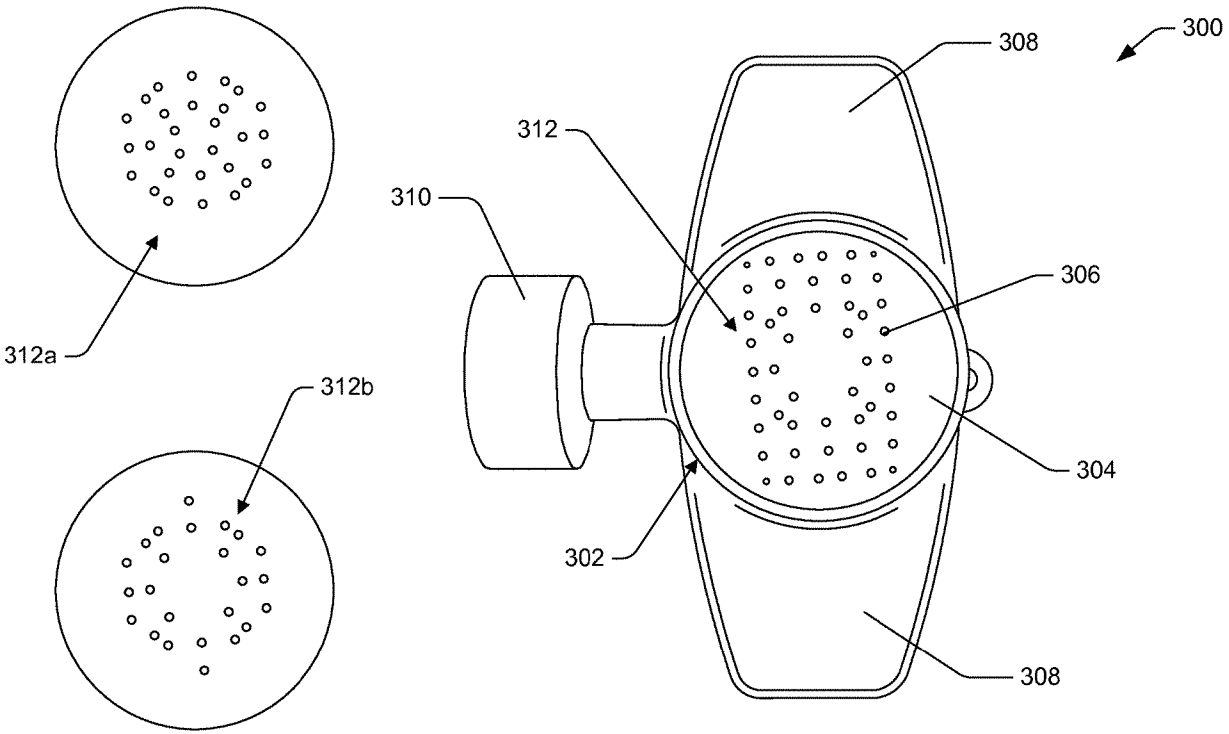
FIG. 3A illustrates a top view of an example embodiment of a sprinkler head.
Figure 3B:
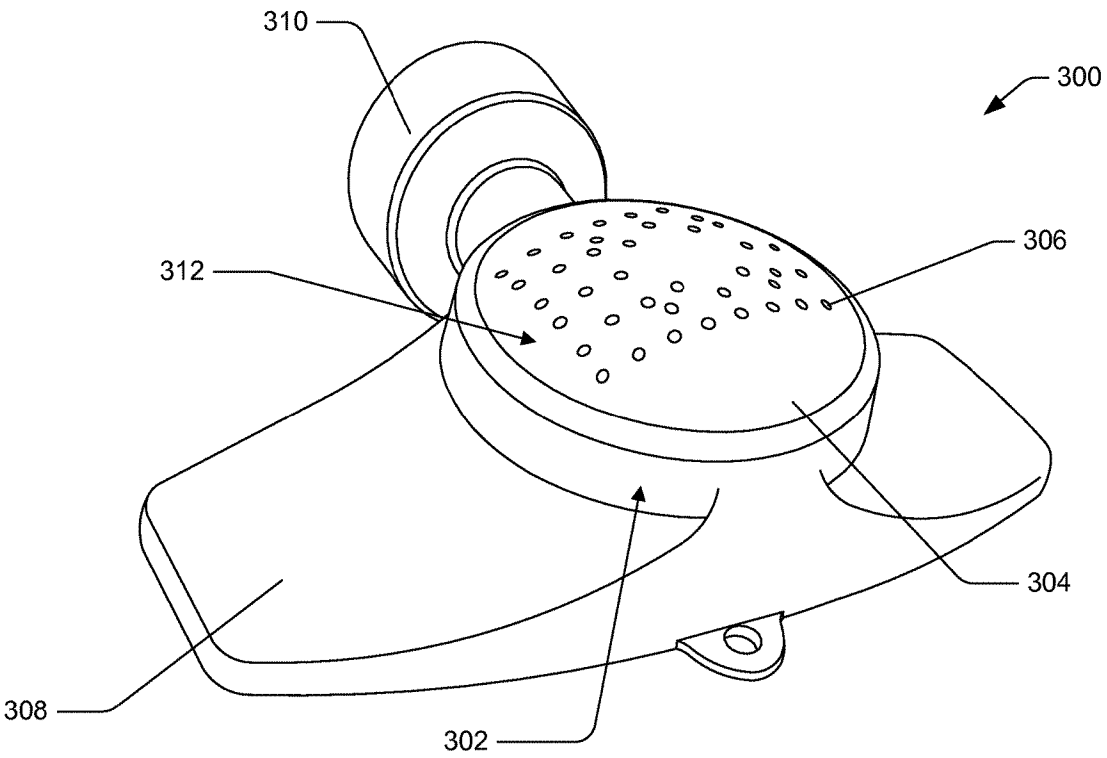
FIG. 3B illustrates a perspective view of an example embodiment of the sprinkler head of FIG. 3A.

In FIGS. 3A and 3B, an embodiment of a sprinkler head 300 is shown from two different perspectives. The sprinkler head 300 may include an internal chamber 302 that defines the main body of the sprinkler head 300 and into which the water flows when device 100 is pressurized. The chamber 302 may be enclosed by a face plate 304 having a plurality of apertures 306 therethrough. The apertures 306 allow water to be sprayed out of the chamber 302.

In some embodiments, the sprinkler head 300 may further include a pair of protrusions 308, extending from opposite sides of the chamber 302. The protrusions 308 may be wing-shaped, or may be any shape that provides balance to the sprinkler head 300 to counter the force of the water as it exits the chamber 302 when pressurized. The protrusions 308 may help stabilize the sprinkler head 300 and prevent erratic movements including turning over and spraying upwards.

Additionally, the sprinkler head 300 may attach to hose 102 via a hose connection member 310. The hose connection member 310 may be a threaded connection or other connection that provides a tight seal to avoid leaking water.

The face plate 304, as shown in FIGS. 3A and 3B, depicts apertures 306 as arranged in a generally rectangular pattern 312. It is contemplated, however, that multiple different patterns (for example, 312*a* and 312*b*) are possible and useful for different watering circumstances. As such, the face plate 304 may be removable and interchangeable with face plates having different aperture patterns. Face plate 304 may be removably attached to the chamber 302 in any way, including for example, by a threaded connection, or by a key/slot rotational connection.

Figure 4A:
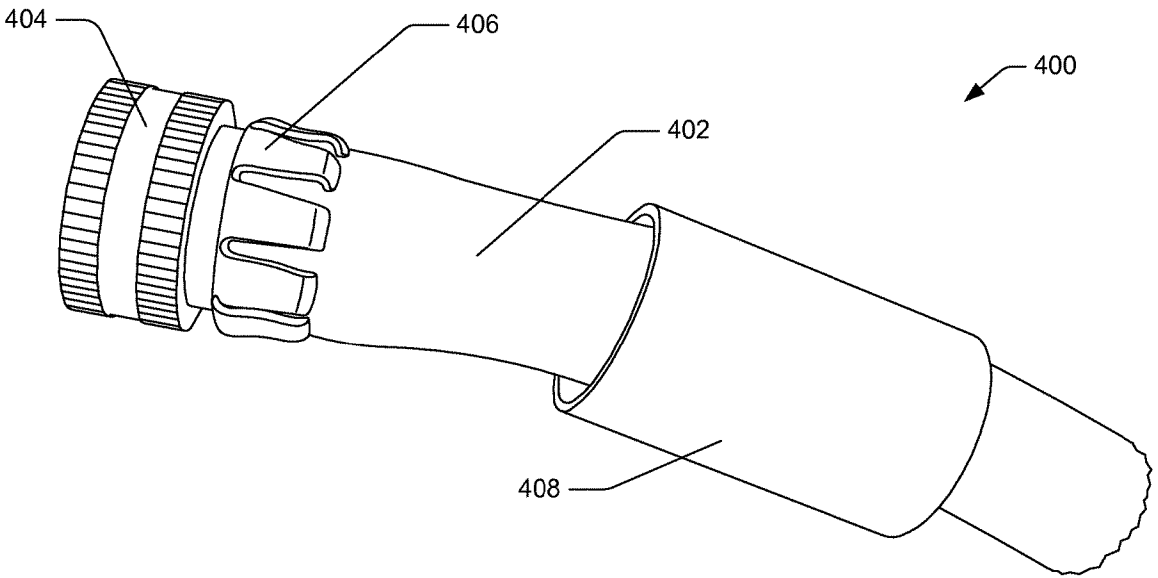
FIG. 4A illustrates an example embodiment of an end of the hose with the sleeve retracted.
Figure 4B:
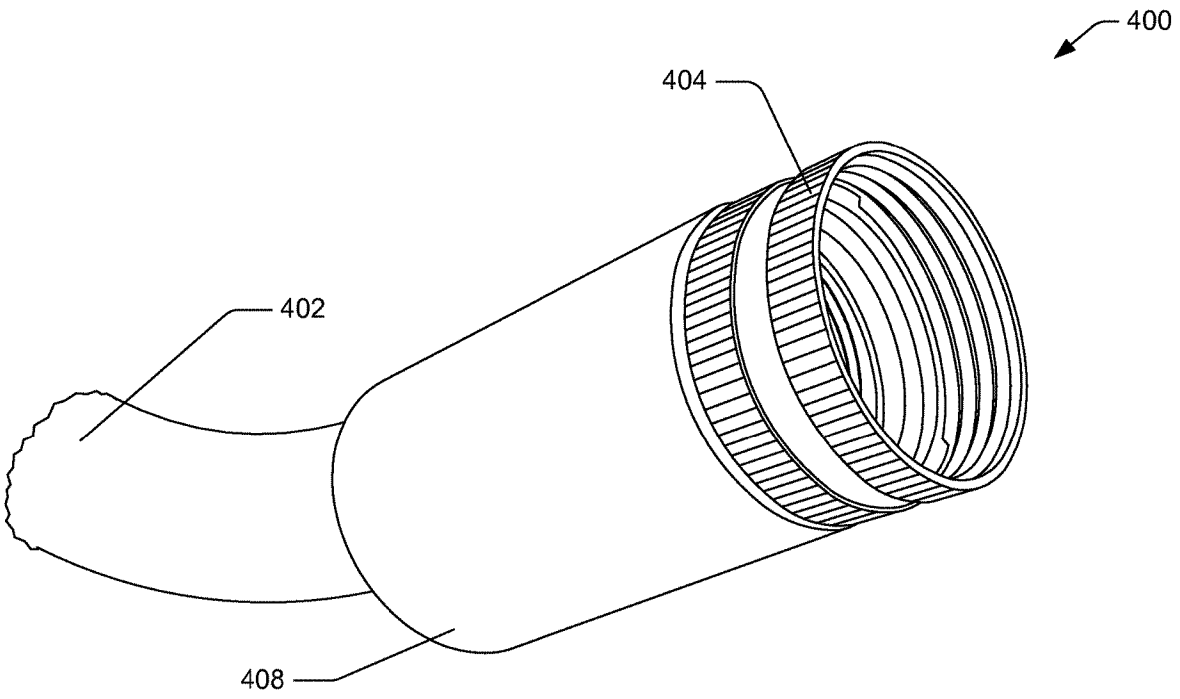
FIG. 4B illustrates an example embodiment of the end of the hose with the sleeve in place.

As discussed above, the hose 102 may be a section of a longer hose, and may need to have additional connection members added thereto for connecting the sprinkler head and the pressure valve. Accordingly, FIGS. 4A and 4B depict an end 400 of a hose 402 in which a hose connector 404 is inserted. The hose connector 404 may be retained tightly in hose 402 by inserting a hose connection coupler 406 into the hose 402 prior to inserting the connector 404. The joint may be sealed with an adhesive, such as a silicon adhesive, and then covered with a shrink wrap sleeve 408.

CONCLUSION

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. An apparatus, comprising:

a hose having first end and a second end, a shape of the hose being such that in an unpressurized state, the hose has a curvature between the first end and the second end such that the first end extends toward the second end;

a sprinkler head coupled to the first end of the hose, the sprinkler head including:

a chamber having a shape defined by a main body, and a face plate having a plurality of apertures therethrough, the sprinkler head being positioned such that the face plate faces toward an inside of the curvature; and a hose coupler including a manually adjustable pressure valve to adjust a water flow through the hose, a first side of the hose coupler being coupled to the second end of the hose, a second side of the hose coupler including a secondary hose attachment member, and the pressure valve being positioned such that a lever of the pressure valve extends outwardly from an outside of the curvature.

2. The apparatus according to claim 1, wherein the curvature of the hose ranges between 1 to 50 degrees.

3. The apparatus according to claim 1, wherein the pressure valve is handheld and the lever controls the water flow via a rotational movement.

4. The apparatus according to claim 3, wherein the external lever attaches to the hose coupler at a single pivot point.

5. The apparatus according to claim 3, wherein the external lever attaches to the hose coupler at two pivot points on opposite sides of the pressure valve.

6. The apparatus according to claim 1, wherein the face plate is removable and interchangeable with alternative face plates having different patterns of apertures.

7. The apparatus according to claim 1, wherein a weight of the sprinkler head is determined with respect to a weight and rigidity of the hose such that, in a pressurized state:

the sprinkler head lifts and the hose extends to a position that is straighter than the curvature when unpressurized, and the sprinkler head remains substantially stable under constant pressure so as enable a user to control a direction of movement of the sprinkler head.

8. An apparatus, comprising:

a tube having a curved shape in an unpressurized state;

a sprinkler head connected to a first end of the tube, the sprinkler head including:

a chamber having a shape defined by walls of a main body and a face plate, and a pair of opposing protrusions that extend away from the walls of the main body; and a coupler attached to a second end of the hose, the coupler including an adjustable pressure valve, and the coupler being connectable to a water source, wherein, when the apparatus is connected to the water source, a water pressure exiting the sprinkler head is adjustable so as to cause the sprinkler head to extend and retract with respect to a curvature of the tube.

9. The apparatus according to claim 8, wherein the face plate includes a plurality of holes dispersed in a predetermined pattern across the face plate.

10. The apparatus according to claim 9, wherein the predetermined pattern of holes is rectangular.

11. The apparatus according to claim 9, wherein the face plate is interchangeable with other face plates having a variety of predetermined patterns of holes.

12. The apparatus according to claim 8, wherein a length of the tube ranges from about 2 to 5 feet.

13. The apparatus according to claim 12, wherein the length of the tube ranges from 2.5 to 3.5 feet.

14. The apparatus according to claim 12, wherein the length of the tube is about 3 feet.

15. An apparatus, comprising:

a hose having a first connector on a first end of the hose and a second connector on a second end of the hose;

a sprinkler head that attaches to the first connector of the hose, the sprinkler head being positioned such that, when the hose receives water pressure, water is ejected from a sprinkler portion in a first direction that is perpendicular to a direction of extension of a central axis of the first connector of the hose; and a handheld water pressure adjustment device that attaches to the second connector of the hose, the pressure adjustment device being positioned with respect to the hose such that a lever of the pressure adjustment device extends perpendicularly to a central axis of the second connector of the hose in a second direction opposite the first direction, wherein, when the hose receives the water pressure and the adjustment device is actuated by a user, the hose is elevated from a first position to a second position when the first direction of the water being ejected is oriented toward a ground surface.

16. The apparatus according to claim 15, wherein a spray pattern of the sprinkler head is adjustable to form different spray patterns.

17. The apparatus according to claim 15, wherein a handle on the pressure adjustment device includes a hand gripping portion for fingers to grip and the lever for adjusting the pressure is disposed on a side of the device opposite the hand gripping portion, so as to be thumb-operated.

18. The apparatus according to claim 15, wherein the lever for adjusting the pressure is operational to increase pressure in two directions.

19. The apparatus according to claim 15, wherein, in an unpressurized state, the hose is curved so that a first end of the hose extends toward a second end of the hose.

20. The apparatus according to claim 15, wherein the lever is disposed on a hand gripping portion as a finger operated trigger.

* * * * *